US007892101B1

(12) United States Patent
Weisz et al.

(10) Patent No.: US 7,892,101 B1
(45) Date of Patent: Feb. 22, 2011

(54) CHILD SWING CHAIR

(75) Inventors: William Weisz, South Orange, NJ (US); Brian Henry, Fort Payne, AL (US)

(73) Assignee: PlayCore, Chattanooga, TN (US)

( * ) Notice: Subject to any disclaimer, the term of this patent is extended or adjusted under 35 U.S.C. 154(b) by 378 days.

(21) Appl. No.: 12/175,543

(22) Filed: Jul. 18, 2008

(51) Int. Cl.
*A63G 9/02* (2006.01)
*A63G 9/00* (2006.01)

(52) U.S. Cl. ..... 472/118; 297/484

(58) Field of Classification Search ..... 472/118–125; 297/273, 274, 467, 476, 484, 487, 256.15
See application file for complete search history.

(56) References Cited

U.S. PATENT DOCUMENTS 5,272,984 A * 12/1993 Bolliger et al. ..... 104/63
5,665,002 A * 9/1997 Balwanz ..... 472/118
5,931,740 A * 8/1999 Kitchen ..... 472/118
6,416,132 B1 * 7/2002 Norton et al. ..... 297/467
6,637,341 B2 * 10/2003 Kroon et al. ..... 104/53
6,893,088 B2 * 5/2005 Kassai et al. ..... 297/250.1
7,175,535 B1 * 2/2007 Marmentini ..... 472/118
7,204,559 B2 * 4/2007 Berra ..... 297/466

* cited by examiner

*Primary Examiner*—Kien T Nguyen
(74) *Attorney, Agent, or Firm*—Stephen J. Stark; Miller & Martin PLLC

(57) ABSTRACT

A child swing chair provides a seat and a rigid harness operably connected thereto which can move from a loaded to an unloaded configuration for ingress and egress from the seat by a user. When the harness is secured relative to the seat, the swing chair preferably passes a rigid bounded opening test as defined by Standard F1487, Paragraph 6.1.1 and the a partially bounded opening test as defined by Paragraphs 6.1.4 of the ASTM Standard in at least some embodiments. In some embodiments, the rigid harness can be supported in an unloaded configuration whereby the harness is in a position allowing for ingress and egress until a predetermined force is overcome to move the harness towards the loaded configuration.

17 Claims, 4 Drawing Sheets

CHILD SWING CHAIR

FIELD OF THE INVENTION

The present invention relates to a child swing chair, and more particularly to a child swing chair configured to meet current rigid bonded opening and/or rigid partially bonded opening standards and/or provide a harness that can remain out of the way during ingress and egress.

BACKGROUND OF THE INVENTION

ASTM International's Standard F 1487 is directed to playground equipment for public use. The current edition is believed to be a 2007 version. The standard provides guidelines for head and neck entrapment which is principally addressed in the form of two tests: one for completely bonded rigid openings, and another for partially bonded openings. Tests provided by this standard in paragraphs 6.1.1 and 6.1.4 are not believed to be met by any prior art swing chair with a rigid child restraint harness on the market. Accordingly, a need exists to meet these current standards. The "standard" and "tests" as referred to throughout this application consistently refer to this standard and these two tests.

As it relates to the bounded rigid opening test, a torso probe is first inserted to see if it can be inserted in the opening in a certain manner. If it can be inserted, then a head probe is inserted to see if it can be admitted. Admitting the torso probe while not admitting the head probe fails the bounded rigid opening test.

The torso probe has a width of 6.2 inches which eventually tapers to a 5.2 inches from a base to a top. A handle is connected at the base. The torso probe used in the test does not have a round cross section. It has a thickness of 3.5 inches where it is 6.2 inches in width. A head probe has a base with a diameter of 9 inches which taper to 8 inches at its top. A handle is attached to the base.

A partially bounded opening test is performed on an opening between 1.875 inches and nine inches. A separate probe referred to as a test template with a 0.75 inch thickness is utilized to test for simultaneous contact. This probe looks somewhat like a diamond when taken along its length cross section. It has a cross section with a maximum width at a middle of about 6.1 inches and tapers to 1.85 inches towards the "points" of the diamond. The base has a 1.875 inch diameter post of 3 inches connected thereto with a base of 8.5 inches. Testing with the torso probe as done by first testing to see if the sides at a top of the probe which is a side opposite the 8.5 inch base touch at the opening when inserted relative to the opening. If they do not touch, then the test is passed. If they do touch, then the opposite side of the template is utilized to see if the test template is completely within the boundaries of the opening. If it is, then the test is failed. If the opening does not allow for that side to fit within the boundaries of the opening, then the partially bounded opening test is passed.

SUMMARY OF THE INVENTION

It is an object of at least one embodiment of the present invention to provide a swing seat meeting current standards for public playgrounds, particularly as it relates to the standard as applied through the bounded rigid opening and partially bounded rigid opening tests.

It is another object of the present invention to provide some embodiments of the present invention to meet the rigid bounded and/or partially bounded opening tests of Paragraphs 6.1.1 and/or 6.1.4 of ASTM F 1487.

It is another object of at least one embodiment of the present invention to provide a no pinch release for a safety harness to reduce an opportunity for potential pinch points and/or provide a displaced configuration to hold the harness out of the way for ingress/egress until a predetermined force is exceeded.

It is another object of at least one embodiment of the present invention to provide an anthropomorphically correct support system for shoulders, waist, torso and/or head for children who desire a supportively structured swing seat.

It is another object of at least some embodiments of the present invention to provide a swing seat which provides an improved quality of play for at least some children.

In accordance with a presently preferred embodiment of the present invention, a swing chair has been developed which is designed to meet the bounded rigid openings test along with the partially bounded rigid opening tests provided by the current standard. Such a construction may preferably provided in two sizes or embodiments, one for two to five year olds and one for five to twelve year olds which may be significantly differently sized children.

In designing a new presently preferred embodiments of the present invention, a rigid safety harness was designed to cooperate with a rigid seat construction in an effort to pass the current standard as required by the bounded rigid opening test as well as the partially bounded rigid opening test.

The applicant is unaware of any prior successful attempt by any manufacturer to succeed in this endeavor. In accordance with this undertaking, the applicant developed a chair configuration which is shown in the drawings and described in detail below. Specifically, two swing chairs embodiments have been created to meet these objectives while providing adequate support. In a first embodiment, a seat is configured with first and second torso supports in the form of wing like structures which may extend cantileveredly from the back of the chair forward in somewhat of a similar manner as the seat rides up around the thighs of a child when engaging in play.

After the child completes play in the seat, the harness can preferably be rotated about a pivot and at least temporarily lock into place. When in use, the head of a child may extend through a yoke in the harness. The remainder of the body of the child is preferably located below the harness when locked. The safety harness preferably secures a child in the seat during play. The locking mechanism may preferably include wing extensions for the two to five year old version which can assist in meeting the bounded and partially opening test issues which may otherwise be created.

For a larger child, a larger version of the chair has been created which may not be required with other embodiments. Wing extensions from the locking member slide may or may not be required in this model to meet the standards as a head probe can enter and exit freely from around that particular area. Also, elevated torso support extensions are provided extending from the back to assist in addressing support as well as possibly ensuring that the standards are met for this chair configuration in which is a little larger than the other embodiment.

The restraining devices are preferably rigid and preferably constructed to pivot at a top portion of the seat back. A cam arrangement is preferably provided so that when the harness or restrainer is pulled or rotated upwardly, it can go to at least temporarily locked or displaced position. A predetermined resistance must then be overcome in order to pull in the harness back over the head of the user so that it preferably does not inadvertently drop down onto a child while getting the child in and out of the chair. Someone also does not need to physically hold the restraint in the up configuration during this process in a preferred embodiment.

In order to disengage the restraining device from a locked configuration, a resiliently biased locking member is preferably provided along a covered end of a slide which is preferably overcome with a force. To unlock from a locked configuration, one disengages an extension of the locking member from a receiver, so the restraining device may then be rotated of engagement and up out of the way. A child may then exit or enter the swing seat.

By providing a swing chair in this manner in accordance with many of the presently preferred embodiments, an improved swing chair can be provided in the marketplace which may provide enhanced play for many people while to be the first time to meet the rigid bounded opening and partially bounded opening tests in a passing manner.

BRIEF DESCRIPTION OF THE DRAWINGS

The particular features and advantages of the invention as well as other objects will become apparent from the following description taken in connection with the accompanying drawings in which.

DETAILED DESCRIPTION OF THE PREFERRED EMBODIMENT

Figure 1:
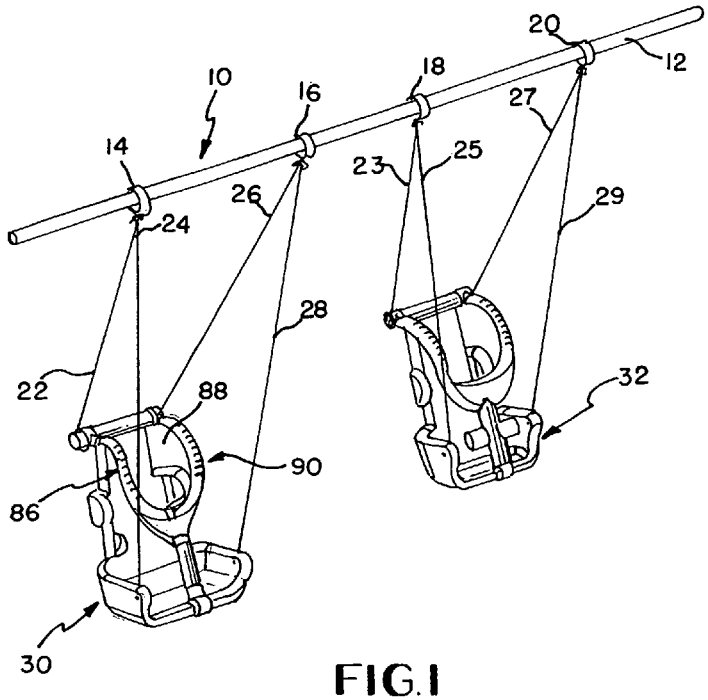
FIG. 1 shows a top elevational view of a swing set having first and second embodiments of swing seats constructed in accordance with presently preferred embodiments of the present invention.

FIG. 1 shows a portion of a swing set 10. Specifically, bar or top rail 12 is shown with brackets 14,16,18,20 connected thereto to which swing chain portions 22,23,24,25,26,27,28,29 are shown connected. At the other end of sets of swing chain portions 22,23,24,25,26,27,28,29, two embodiments of swing chairs 30,32 are connected. Details of the connections to the swing chairs 30,32 are shown with reference to FIGS. 5 and 6 and are discussed below.

Figure 12:
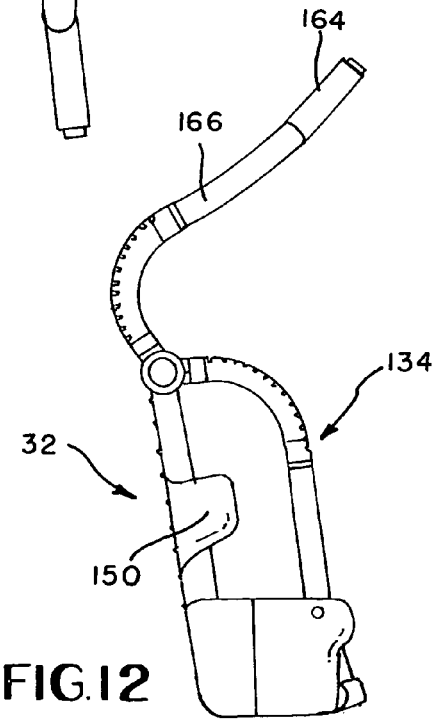
FIG. 12 shows a side plan view illustrating the operation of the retainer harness relative to the other seat embodiment shown in FIG. 1 in both a loaded and displaced configuration (the other illustrated embodiment preferably works similarly)
Figure 13:
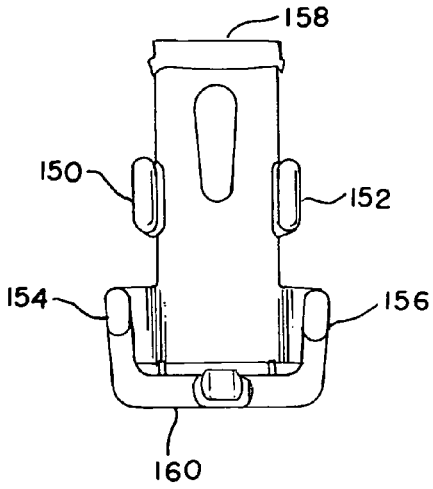
FIG. 13 shows a front plan view of the seat shown in FIG. 12 with the retainer harness removed.

Swing chairs 30,32 are illustrated with two separate embodiments of what is hoped to be a common invention for at least some embodiments. Both of these embodiments have been designed to meet the current standards as provided by ASTM International for Standard 1487 directed to playground equipment for public use. More particularly both meet the bounded rigid opening test and the partially bounded rigid opening test (paragraphs 6.1.1 and 6.1.4 of that standard) which is believed to be a first for a swing chair having a rigid harness as will be discussed in further detail below. The first embodiment of a swing chair 30 is shown in further detail with references to FIGS. 2-11, although FIGS. 5-6, and 8-9 refer to both embodiments. Similarly, the operation of the harness as is shown in FIG. 12 is similarly applicable as it relates to the embodiment shown in FIGS. 2-11.

Figure 2:
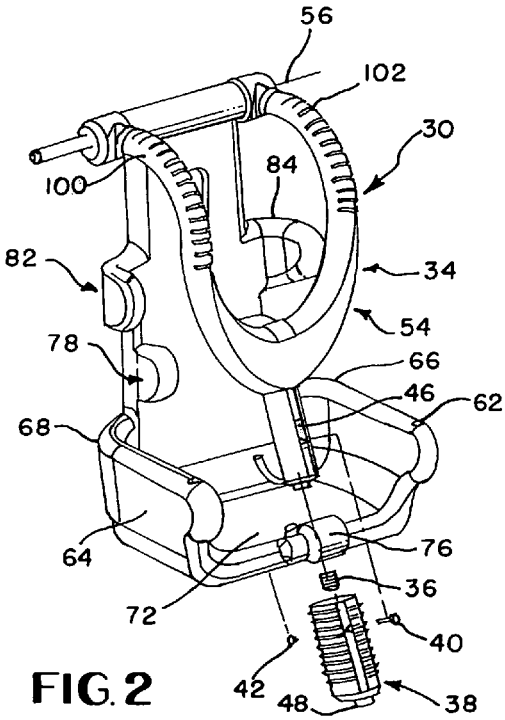
FIG. 2 is a partially exploded view of a first presently preferred embodiment of a swing seat shown in FIG. 1.

In looking at a more detailed view of the swing chair 30, FIG. 2 shows a rigid harness 34 in a partially disassembled state. Specifically, resilient member 36 has been removed along with slide 38 as well as bolt 40 and nut 42 which are preferably utilized to retain the slide 38 relative to post 44 such as within slot 46 so that the slide 38 can reciprocate linearly relative to post 44 but is preferably biased in a locking or loaded configuration by resilient member 36 as would be understood by one of ordinary skill in the art. The slide 36 is preferably resiliently biased in the locked configuration with extension 48 retained in at least one of the receivers 50,52 shown in FIG. 4 which will be described in further detail with reference to that figure. As one may understand from referenced FIGS. 1, 2 and 4, in order to disengage the harness, the slide 38 is preferably pushed or pulled upwardly towards yoke 54 of harness 34 thereby disengaging extension 48 from one of the first or second receivers 50,52 and therefore allowing the harness 34 to be rotated about axis 56 upwardly and outwardly out of the way as is shown with reference to FIG. 12 and will be explained below. This allows for the ingress and egress of children in the seat 30 with the harness in an unlocked configuration.

Having two receivers 50,52 can allow for the adjustment of the harness 34 to a desired level of comfort which may or may not be based on the size of the child utilizing the swing chair 30. Some larger kids may select second receiver 52; some smaller children may select first receiver 50. Additional receivers could be provided with other embodiments.

Figure 3:
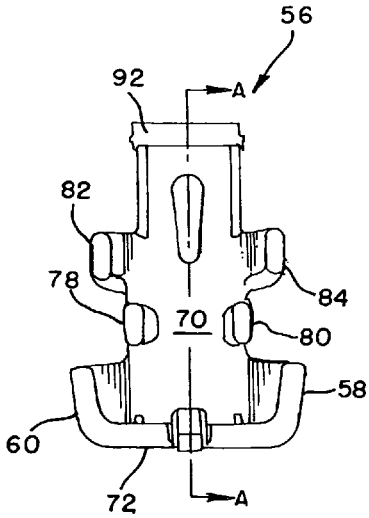
FIG. 3 is a front plan view of the seat shown in FIGS. 1 and 2 with the restraining harness removed.

FIG. 3 shows seat 56 shown apart from swing chair 30. Seat preferably has pelvic supports 58,60 which extend up above at least a portion of the pelvic area of a user along sides 62,64 as well as preferably at back portions 66,68. Back 70 connects to base 72. The pelvic supports 58,60 are illustrated extending upwardly from base 72 as well as outwardly from back 70 at back portions 66,68. Towards the front of base 72 or in front of base 72 are located receivers 50,52 which are illustrated as extending from tongue 74 which may or may not be present in all embodiments. Tongue 74 is illustrated extending forward of seat 56 with knob 76 which may facilitate the introduction of extension 48 into at least one of the receivers 50,52.

Figure 4:
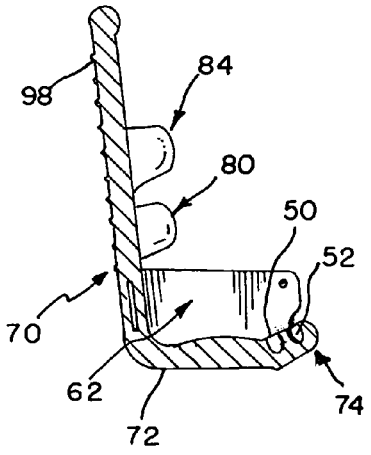
FIG. 4 is a cutaway view taken along the line A-A of FIG. 3.

Extending from back 70 are first torso supports 78,80 and second torso supports 82,84 which are illustrated disposed above first torso supports 78,80. First torso supports 78,80 are shown in FIG. 4 and are illustrated as extending from the back 70 forwardly preferably in a cantilevered manner such as in a direction parallel to a plane containing seat 56. Second torso supports 82,84 may extend along the plane of the back 70 and then forwardly in a direction at least substantially parallel to the direction of the first torso support 78,80. Other configurations than this preferred configuration can also be provided with other embodiments. This configuration has been particularly attractive for reasons described below.

By having first and second torso supports 78,80,82,84 not only is support provided to the torso, but first torso supports 78,80 may address the lumbar or slightly higher region of a child's or other user's back while the second torso supports 82,84 may be more aligned to the underarm, shoulder or arm portions or other back portions of the user for support. Supports 78,80,82,84 may also provide advantages as it relates to passing the bounded opening or partially bounded opening tests as will be described in detail below.

A bounded and partially bounded opening test as provided by the current standards are passed by a presently preferred embodiment. Specifically, with the harness 34 installed in an installed configuration such as shown in FIG. 1 at least three bounded openings are created. Specifically, see first, second and third bounded openings 86,88,90. Bounded openings 90 and 86 are illustrated as mirror images of one another on opposite sides of the harness 34 relative to the seat 56. Partially bounded openings may also be present. The bounded rigid opening test is first analyzed utilizing a torso probe. If the torso probe can be inserted into any of the openings 86,88,90 a depth of four inches or more, then the head probe is then inserted. The bounded openings pass this test if (1) the openings do not admit the torso probe as rotated in any rotation about its axis, or (2) the head probe can be fully inserted. By having the torso supports 78,80,82,84 constructed in a manner as they are, they prevent either of these two events from occurring, particularly, when taken into connection with the pelvic supports 58,60 as constructed and illustrated. If the opening admits a torso probe but does not admit the head probe, the test is failed. Other embodiments may have other constructions which when utilized in combination with the harness 54 prevent this test from being passed.

To the extent any partially bounded rigid openings are created, then the template test is also passed with the construction as shown and illustrated herewith. The template described in the background of the inventor is utilized to check partially bounded openings (openings between 1.875 and 9 inches as is described in the background of the invention.

In order to accomplish this or these feat(s) for a first preferred embodiment, the height from the top of second torso support to the top of pivot arm 92 is about ten inches while the height from the top of the pivot arm to the top of the pelvic support 58,60 is about 22 inches while the overall height from the top of the pivot arm 92 to the bottom of the base 72 is about 30 inches. Pivot arm has a diameter of roughly two and a half inches. The back 70 is preferably angled relative to the base preferably at least slightly.

Distances identified as measured from the back 70 are actually measured referenced to the back of the pivot arm 92. The tongue extends out roughly 19¼ inches therefrom. The first and second torso supports 78,80,82,84 extend roughly 7¼ inches from the back of the pivot arm 92, and the front chain connection points 94,96 extend roughly 15½ inches from the back of the pivot arm 92. The front of the pelvic support extends roughly 17% inches from the back of the pivot arm 92.

From the exterior side of the pelvic supports 62,64 to a center line of the tongue 74 is roughly 10¼ inches while the total width from the exterior sides of the pelvic support 62 to 64 is roughly 20½ inches. The width of the pelvic support 58,60 is roughly 2 inches at a top portion of the pelvic support 58,60. Along the back 70 are preferably a plurality of bars 98 which preferably extend therefrom (which could also be replaced with slots in the back 70) which preferably provide roughly at least about 2 inches of spacing therebetween for receipt of a seat belt if utilized by a parent of a child to assist in keeping any particular child in the swing chairs 30,32 which may be advantageous in some situations. For this embodiment the harness 34 would preferably have a maximum width between yolk arms 100,102 of 10 inches.

Figure 10:
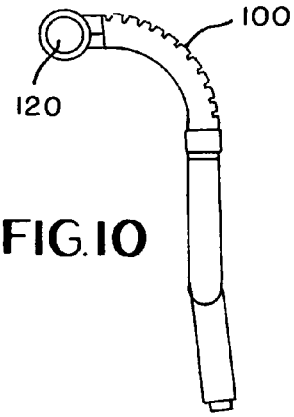
FIG. 10 shows a side plan view the retainer removed from the seat shown in FIGS. 1 and 2.
Figure 11:
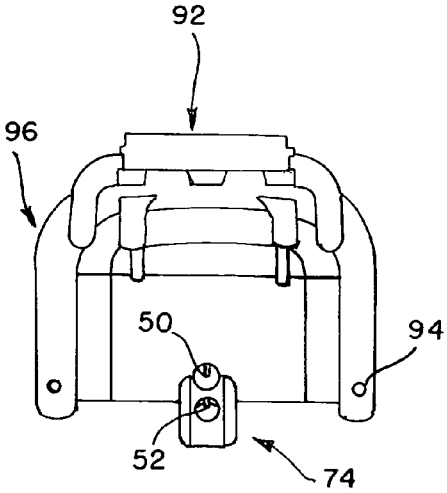
FIG. 11 shows a top plan view of the seat shown in FIGS. 1-4, and 7.

A maximum width across the yoke arms 100,102 where connected to pivot arm 92 is roughly 15½ inches. The extension 48 is roughly half an inch and is preferably angled about 5 or 15 degrees with post 44 being angled at an angle of 15 degrees relative to yoke body 104 as shown in FIG. 10. Slot 46 may have a length from top to bottom of roughly 2½ inches. The yoke arms 100,102 may start to extend upwardly from the yoke body 104 at a spacing of roughly 5½ A inches. The combination of all these dimensions and angles have assisted in the applicant being able to meet what is believed to be the first time the standard for the bounded opening and partially bounded opening test for a rigid swing seat with a rigid harness. Other dimensions and angles may be employed to meet the test standards with other embodiments.

Figure 5:
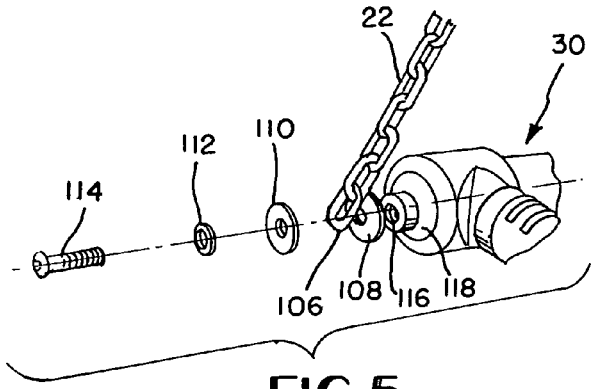
FIG. 5 is an exploded view of a connection of the presently preferred embodiments of the swing seats to their respective chains as is shown in FIG. 1.
Figure 7:
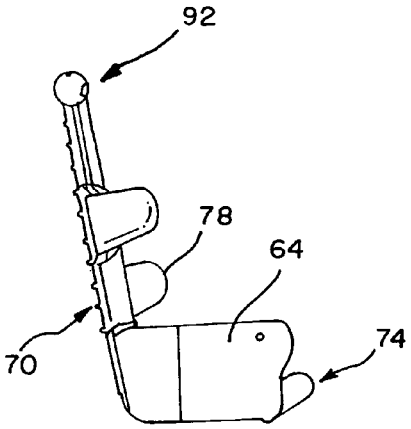
FIG. 7 shows a side plan view of the seat embodiment shown in FIGS. 1-4.

With reference to FIG. 5 connection of the chain portion 22 to the swing chair 30 is illustrated with link 106 being constrained between washers 108,110 with lock washer 112 and bolt 114 extending therethrough into bore 116 which may be on boss 118. Boss 118 may or may not extend through bore 120 while connected to upper portions of yoke arms such as yoke arm 100 illustrated in FIG. 10. Upper portions of the connection of the yoke arms 100,102 connect to pivot arm 92.

Figure 8:
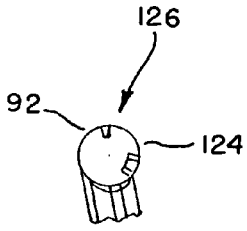
FIG. 8 shows a detailed plan view of a portion of the seat where it connects to the chain showing the details which assist in providing stops in a presently preferred embodiment in both seat embodiments shown in FIG. 1.
Figure 9:
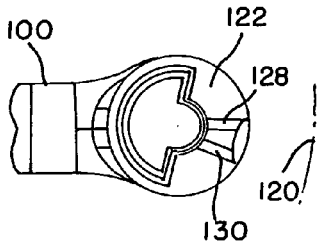
FIG. 9 shows a side plan view cooperating portion of the retainer harness which cooperates with the seat portion shown in FIG. 8 of the presently preferred embodiments.

In looking at the other side of the yoke arm 100 where it connects to pivot arm 92 (see FIGS. 8 and 9), a lock displaced configuration may be provided in a presently preferred embodiment. Specifically, FIGS. 8 and 9 are particularly helpful. The boss 118 (not shown in these figures) may extend through the bore 120 shown in FIG. 10, a recess 120 is provided on face 122 which preferably receive one of two protrusions 124,126 extending from pivot arm 92 as illustrated in FIG. 8. As the recess 100 is rotated and possibly provided with slants 128,130 which may cooperate with correspondent slants or not on the protrusions 124,126 so that when the harness 34 is in a loaded configuration such as shown in FIGS. 1 and 12 with the harness (taken in mind that that is a slightly different configuration of harness) but shows the loaded configuration with the harness 134 in an engaged configuration when shown in the down configuration and a fully raised configuration when shown in the up position which would be understood with reference to FIG. 12 which could also be the displaced configuration.

The recess 120 preferably located within protrusions 124, 126 in these positions or configurations. When in the up position with the recess 120 cooperating with the second protrusion 126, a predetermined amount of force is preferably required to disengage that when in the displaced configuration. When the harness 134 is rotated to that configuration, it can stay in the up position thereby providing a hands free ability to ingress and egress from the swing chairs 30,32. This is also believed to be a novel feature over prior art swing chairs for at least some embodiments.

Figure 6:
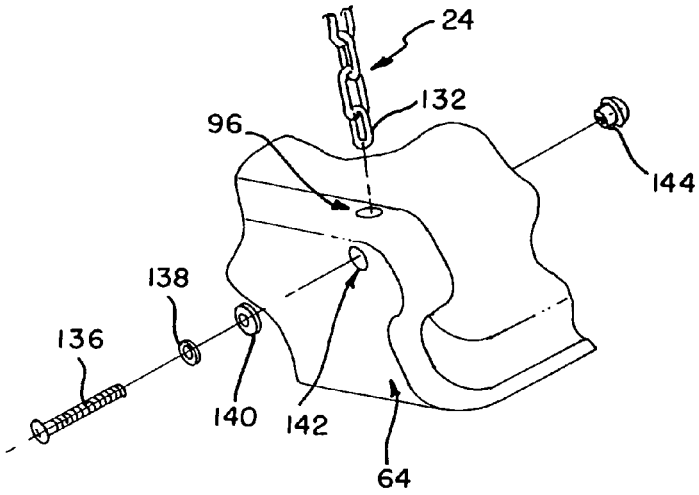
FIG. 6 shows an exploded view of a connection of the chain to a lower portion of the seats as shown in FIG. 1.

FIG. 6 shows a chain connection point 96 connected to link 132 of swing chain portion 24. Bolt 136 is illustrated extending through lock washer 138 and washer 140 through bore side 64 with corresponding barrel nut 142 being received interiorly to the side 64 and providing connection with an effort to minimize a potential of pinching by a user.

Figure 14:
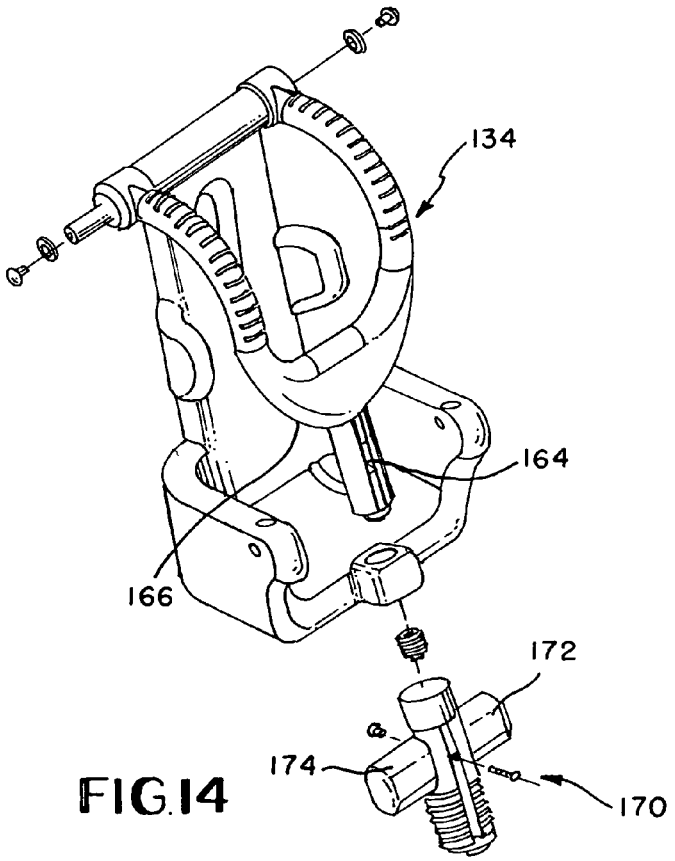
FIG. 14 shows a partially exploded view of the seat and harness shown in FIGS. 1 and 12.
Figure 15:
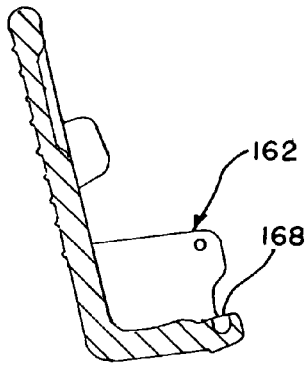
FIG. 15 shows a cross sectional view taken along the center line of the seat shown in FIGS. 1 and 12-14.

While this embodiment has been particularly effective for children five and above, such as to twelve, smaller swing chairs may be an attractive option for smaller children. An embodiment shown in of FIGS. 12-15 have been particularly effective for smaller children but are based on essentially the same principal as that of a larger child as it relates to meeting the standards. Swing chair 32 is shown in FIG. 12 and has torso supports 150,152. Pelvic supports 154,156 are also provided. It is worth observing that the distance between the pelvic supports 154,156 is somewhat narrower than for the other illustrated embodiment to accommodate a smaller child. Furthermore, for this size chair although additional torso supports could be utilized, and are not illustrated due to the smaller size of the chair. Instead of being the taller height as described above the distance from the pivot arm 158 to the bottom of the base 160, roughly 28 inches in height is provided for the presently preferred embodiment. The distance from the top of the pivot arm 158 to the top of the first and second torso supports 150,152 can be roughly 9¼ inches. The distance to the top of the pelvic supports 154,156 can be roughly 18¾ inches. The torso supports 150,152 are illustrated extending roughly 6¼ inches from the back of the pivot arm 158. The forward chain connection points may extend forward roughly 12 inches from the back of the pivot arm. When cooperating with the harness 134, as shown in FIGS. 12, 14 and 1, the rigid bounded opening test is passed. The partially bounded opening test is also passed.

The harness 134 may have a maximum width of 10 inches. The angularly relationship may be 5 degrees instead of 15 degrees as it relates to the angular relationship of the post 164 relative to yoke base 166 rather than the 15 degrees as is utilized in the other embodiments. Various angular relationships and dimensions could be provided with other embodiments. Other dimensions can be provided with other embodiments. Furthermore, all the parts are not required as illustrated. Omission of the second set of torso supports are illustrated and described explicitly being omitted in the smaller version directed to two to five year olds.

A single receiver 168 may utilize a smaller chair as the chair as is believed to be appropriately sized for smaller children. If a larger child wants to utilize a seat, they can utilize the five to twelve year old embodiment of FIGS. 1-11 or another embodiment. In order to assist in meeting the bounded opening test, the slide 170 may be slightly differently configured than the slide 138 in that it may have first and second wings 172,174 extending therefrom which are believed to assist in meeting the bounded opening and/or partially bounded opening tests as provided by the ASTMs to prevent inadvertent entrapment of a child's head relative to a torso. Wings with distance across the wings as illustrated is roughly 10¼ inches whereas the other slide 38 has a maximum width of roughly 3¼ inches which could be consistent with the width of the slide 170 at its bottom portion 176.

Numerous alterations of the structure herein disclosed will suggest themselves to those skilled in the art. However, it is to be understood that the present disclosure relates to the preferred embodiment of the invention which is for purposes of illustration only and not to be construed as a limitation of the invention. All such modifications which do not depart from the spirit of the invention are intended to be included within the scope of the appended claims.

Having thus set forth the nature of the invention, what is claimed herein is:

1. A swing chair comprising:

a seat having a base connected to a back, said seat suspended above a ground surface by swing chain portions from a bar whereby the seat may swing relative to the bar;

a rigid harness operably coupled to the seat at an upper portion of the back, said swing chair having a loaded configuration wherein the harness is secured from movement by the seat and an unloaded configuration wherein the harness is moved relative to the base of the seat to permit access for ingress and egress from the seat by a user; wherein when in the loaded configuration at least one of the harness and seat provide at least one rigid bounded opening, and the swing chair passes a rigid bounded opening test as defined by standard F 1487 paragraph 6.1.1 and a partially bounded opening test as defined by paragraphs 6.1.4;

at least a first receiver connected to the base which connects to a portion of the harness in the loaded configuration;

a slide operably coupled to the harness, said slide connected to an extension which cooperates with the receiving in the loaded configuration, said slide biased into a first position which assists in maintaining the swing chair in the loaded configuration, and said slide movable to a second position disengaging the extension from the receiver allowing the harness to be moved relative to the seat; and wings extending cantileveredly from the slide.

2. The swing chair of claim 1 further comprising a displaced configuration wherein the harness is held in a fixed position relative to the seat until a predetermined force is overcome to move the harness relative to the seat.

3. The swing chair of claim 2 wherein the seat has a pivot arm disposed toward the upper portion of the back and the harness rotates relative to the pivot arm intermediate the displaced configuration and the loaded configuration.

4. The swing chair of claim 1 further comprising torso supports extending forwardly from the back of the seat.

5. The swing chair of claim 4 wherein the torso supports further comprise at least two pairs of torso supports extending forwardly from the back of the seat.

6. The swing chair of claim 1 wherein the seat has pelvic supports extending upwardly from the base and the wings are disposed at a mid portion of the slide and extend towards the pelvic supports.

7. A swing chair comprising:

a seat having a base connected to a back, said seat suspended above a ground surface by swing chain portions from a bar whereby the seat may swing relative to the bar;

a rigid harness operably coupled to the seat at an upper portion of the back, said swing chair having a loaded configuration wherein the harness is secured from movement by the seat and an unloaded configuration wherein the harness is moved relative to the base of the seat to permit access for ingress and egress from the seat by a user; wherein when in the loaded configuration at least one of the harness and seat provide at least one rigid bounded opening, and the swing chair passes a rigid bounded opening test as defined by standard F 1487 paragraph 6.1.1 and a partially bounded opening test as defined by paragraphs 6.1.4; and at least two receivers connected to the base thereby providing at least two loaded configurations.

8. The swing chair of claim 7 further comprising a tongue extending cantileveredly forward of the base said receiver located in one of the base and tongue.

9. A swing chair comprising:

a seat having a base connected to a back, said seat suspended above a ground surface by swing chain portions from a bar whereby the seat may swing relative to the bar; and a rigid harness operably coupled to the seat at an upper portion of the back, said swing chair having a loaded configuration wherein the harness is secured from movement by the seat, an unloaded configuration wherein the harness is moved relative to the base of the seat to permit access for ingress and egress from the seat by a user; and a displaced configuration wherein while in the unloaded configuration, the harness is secured from movement toward the loaded configuration by a protrusion from the seat which engages a recess of the harness until at least a predetermined force is overcome to then be able to move the harness towards the loaded configuration thereby disengaging the protrusion from the recess.

10. The swing chair of claim 9 wherein when in the loaded configuration at least one of the harness and seat provide at least one rigid bounded opening, and the swing chair passes a rigid bounded opening test as defined by standard 6.1.1 and a partially bounded opening test as defined by standard 6.1.4, if applicable.

11. The swing chair of claim 9 wherein the seat has a pivot arm connected to the back and the harness is pivotally connected to the seat at the pivot arm.

12. The swing chair of claim 11 wherein the harness has yoke arms configured to extend around a head of the user in the loaded configuration and a connection of at least one of the yoke arms with the pivot arm at least assists in securing the harness in the displaced configuration.

13. The swing chair of claim 12 wherein one of the pivot arm and at least one of the yoke arms has the protrusion.

14. The swing chair of claim 13 wherein the recess has a slanted surface which at least assists in the protrusion exiting the recess upon application of at least a predetermined force.

15. The swing chair of claim 9 further comprising torso supports extending forwardly from the back of the seat.

16. The swing chair of claim 15 wherein the torso supports extend cantileveredly from the back of the seat.

17. The swing chair of claim 9 wherein the harness further comprises a slide which has an extended and a retracted position and when in the extended position engages with a receiver connected to the base in the loaded configuration and disengages from the receiver when in the retracted position.

* * * * *